US009565989B2

(12) United States Patent
Maier et al.

(10) Patent No.: US 9,565,989 B2
(45) Date of Patent: Feb. 14, 2017

(54) RACK FOR DISHWASHERS, IN PARTICULAR COMMERCIAL DISHWASHERS

(71) Applicants: Daniel Maier, Bruhl (DE); Udo Burkle, Hohberg (DE); Bjorn Brodowski, Hohberg (DE)

(72) Inventors: Daniel Maier, Bruhl (DE); Udo Burkle, Hohberg (DE); Bjorn Brodowski, Hohberg (DE)

(73) Assignee: PREMARK FEG L.L.C., Glenview, IL (US)

( * ) Notice: Subject to any disclaimer, the term of this patent is extended or adjusted under 35 U.S.C. 154(b) by 0 days.

(21) Appl. No.: 14/772,949

(22) PCT Filed: Feb. 24, 2014

(86) PCT No.: PCT/US2014/017895

§ 371 (c)(1),
(2) Date: Sep. 4, 2015

(87) PCT Pub. No.: WO2014/163838

PCT Pub. Date: Oct. 9, 2014

(65) Prior Publication Data

US 2016/0007824 A1 Jan. 14, 2016

(30) Foreign Application Priority Data

Mar. 12, 2013 (DE) ..... 10 2013 004 184

(51) Int. Cl.
*A47L 15/50* (2006.01)
*A47L 15/00* (2006.01)

(52) U.S. Cl.
CPC ..... *A47L 15/50* (2013.01); *A47L 15/0065* (2013.01); *A47L 15/0076* (2013.01); *A47L 15/501* (2013.01)

(58) Field of Classification Search
CPC .. A47L 15/50; A47L 15/0076; A47L 15/0065; A47L 15/501
(Continued)

(56) References Cited

U.S. PATENT DOCUMENTS 542,734 A * 7/1895 Johnson ..... A47L 19/04 211/41.4
3,009,579 A 11/1961 Ettlinger, Jr.
(Continued)

FOREIGN PATENT DOCUMENTS

AU 530796 B2 7/1983
DE 8000330 U1 4/1980
(Continued)

OTHER PUBLICATIONS

PCT, International Search Report and Written Opinion, International Application No. PCT/US2014/017895, mailed Apr. 9, 2014.

*Primary Examiner* — Korie H Chan
(74) *Attorney, Agent, or Firm* — Thompson Hine LLP

(57) ABSTRACT

A rack for dishwashers, in particular for commercial dishwashers, is provided. With the aim of making optimum use of space in the rack, and of discharging residual water as best as possible, it is proposed, that the rack has a rack framework (20) with two directly adjacent set-down surfaces (SI, S2) which are intended for washware (10) and run parallel to one another in the longitudinal direction of the rack, wherein the set-down surfaces (S) are inclined in relation to the horizontal such that the surface normals (F1, F2) of the set-down surfaces (S 1, S2) diverge.

14 Claims, 7 Drawing Sheets

(58) Field of Classification Search
USPC ..... 211/41.8
See application file for complete search history.

(56) References Cited

U.S. PATENT DOCUMENTS

| | | | | | |
|---|---|---|---|---|---|
| 3,169,641 | A * | 2/1965 | Chapman | A47L 19/04 | 211/41.4 |
| 3,266,632 | A * | 8/1966 | Maslow | A47L 15/501 | 211/41.8 |
| 4,475,656 | A * | 10/1984 | Collier | A47L 15/50 | 211/106 |
| 6,109,455 | A | 8/2000 | Schroeder | | |
| 2001/0047968 | A1 * | 12/2001 | Wright | A47L 19/04 | 211/41.3 |

FOREIGN PATENT DOCUMENTS

| | | | |
|---|---|---|---|
| DE | 19736793 | A1 | 2/1999 |
| DE | 19960264 | A1 | 6/2001 |
| DE | 102009044831 | A1 | 6/2011 |
| EP | 0661019 | A1 | 7/1995 |
| EP | 1300107 | A1 | 4/2003 |
| EP | 1649798 | A1 | 4/2006 |
| EP | 2036482 | | 3/2009 |
| GB | 2039212 | A | 8/1980 |

* cited by examiner

RACK FOR DISHWASHERS, IN PARTICULAR COMMERCIAL DISHWASHERS

The present invention relates to a rack for dishwashers according to the preamble of independent patent claim 1.

The rack according to the invention is suitable, in particular, for a commercial dishwasher which is designed as a box-type dishwasher or as a rack-conveyor dishwasher.

Box-type dishwashers, also known as batch dishwasher, are dishwashers which can be loaded and unloaded manually. These include hood-type dishwashers or front-loader dishwashers. Front-loader dishwashers may be in the form of under-counter machines, counter-top machines or free-standing front-loader dishwashers.

A dishwasher designed in the form of a box-type dishwasher usually has a treatment chamber for cleaning washware. The treatment chamber usually has arranged beneath it a wash tank, in which liquid can flow back out of the treatment chamber under gravitational force. The wash tank contains wash liquid, which is usually water, to which, if appropriate, detergent can be supplied.

A dishwasher designed in the form of a box-type dishwasher also has a wash system having a wash pump and a line system, connected to the wash pump, and a multiplicity of spray nozzles formed in at least one wash arm. The wash liquid located in the wash tank can be delivered by the wash pump, via the line system, to the spray nozzles and sprayed in the treatment chamber, by the spray nozzles, onto the washware which is to be cleaned. The sprayed wash liquid then flows back into the wash tank.

The conveyor dishwashers in question here are, in particular, rack-conveyor dishwashers (rack-conveyer ware washers), which are used usually in the commercial sector. In contrast to box-type dishwashers, in which the washware which is to be cleaned remains at a fixed location in the machine during the cleaning operation, the washware in conveyor dishwashers is conveyed through different treatment zones of the conveyor dishwasher.

A conveyor dishwasher usually has at least one pre-wash zone and at least one main wash zone, which is arranged downstream of the pre-wash zone(s), as seen in the conveying direction of the washware. Usually at least one post-wash zone is arranged downstream of the main wash zone (s), and at least one final rinse zone is arranged downstream of the post-wash zone, as seen in the conveying direction. As seen in the conveying direction, the washware, which in the case of rack-conveyor dishwashers is retained by racks, runs, in the conveying direction, usually through an entrance tunnel, the following pre-wash zone(s), main wash zone(s), post-wash zone(s), final rinse zone(s) and a drying zone into an exit section.

The aforementioned wash zones of the conveyor dishwasher are each assigned a wash system which has a wash pump and a line system, which is connected to the wash pump and via which liquid is supplied to the spray nozzles of the wash zone. The wash liquid supplied to the spray nozzles is sprayed, in the respective wash zone, onto the washware, which is conveyed through the respective wash zones by a conveying apparatus of the conveyor dishwasher. Each wash zone is assigned a tank, in which sprayed liquid is accommodated and/or in which liquid for the spray nozzles of the relevant zone is supplied.

In the case of the conveyor dishwashers which are known customarily from the prior art, final rinse liquid in the form of fresh water, which may be in pure form or have further additives, for example rinse aid, mixed with it, is sprayed onto the washware via the spray nozzles of the final rinse zone. At least some of the sprayed final rinse liquid is conveyed from zone to zone, counter to the conveying direction of the washware, via a cascade system.

The sprayed final rinse liquid is collected in a tank (post-wash tank) of the post-wash zone, from which it is delivered to the spray nozzles (post-wash nozzle) of the post-wash zone via the wash pump of the wash system belonging to the post-wash zone. In the post-wash zone, wash liquid is rinsed off, from the washware. The liquid which accumulates here flows into the wash tank of the at least one main wash zone, which is arranged upstream of the post-wash zone, as seen in the conveying direction of the washware. Here, the liquid is usually provided with a detergent and is sprayed onto the washware by a pump system (wash pump), which belongs to the wash system of the main wash zone, via the nozzles (wash nozzles) of the main wash zone. From the wash tank of the main wash zone, the liquid then flows—if there is no further main wash zone provided—into the supply tank of the pre-wash zone. The liquid in the pre-wash tank is sprayed onto the washware via a pump system, which belongs to the wash system of the pre-wash zone, via the pre-wash nozzle of the pre-wash zone, in order for coarse soiling to be removed from the washware.

Irrespective of whether the dishwasher is designed in the form of a box-type dishwasher or of a rack-conveyor dishwasher, the washware which is to be cleaned is usually placed in a rack, which is then supplied to the wash chamber (in the case of box-type dishwashers) or to the treatment zones (in the case of rack-conveyor dishwashers. In the racks which are known from the prior art, the washware, in particular glasses, cups and plates, is positioned in a state in which it is sorted in each case in set-down tracks of the rack framework.

It is an object of the invention to specify a rack, in particular a rack for accommodating glasses for glasswashers (glass-carrying rack), of which the design is optimized such that it is easier for the rack to be charged with washware items, in particular drinking glasses, wine glasses or glass carafes.

In particular, the intention is to specify a rack which can easily be charged both with small drinking glasses and with long-stem glasses, in particular wine glasses or champagne glasses, wherein, at the same time, the quantity of washware items which can be accommodated in the rack is optimized in respect of the surface area of the rack.

This object is achieved according to the invention by the subject matter of independent patent claim 1.

Claim 1 specifies a rack for dishwashers, in particular commercial dishwashers, wherein the rack has a rack framework with two directly adjacent set-down surfaces which are intended for washware and run parallel to one another in the longitudinal direction of the rack, wherein the set-down surfaces are inclined in relation to the horizontal such that the surface normals of the set-down surfaces diverge.

The rack according to the invention is suitable, in particular, for use in commercial dishwashers which are designed in the form of box-type dishwashers or of rack-conveyor dishwashers.

Since the rack according to the invention has a rack framework with two directly adjacent set-down surfaces which are intended for washware and run parallel to one another in the longitudinal direction of the rack, wherein the set-down surfaces are inclined in relation to the horizontal such that the surface normals of the set-down surfaces diverge, it is the case that, in the fully charged state of the rank, there is no "dead space" between the two parallel set-down surfaces. This means that—as seen in relation to the surface area of the rack—the highest possible number of washware items can be accommodated in the rack.

The invention also provides for the two set-down surfaces to run obliquely relative to the horizontal plane, which, following completion of the final rinse operation, assists the previously sprayed-on final rinse liquid on being channeled away quickly from the washware items and reduces the accumulation of water droplets on the washware items.

It is advantageous here if the fresh water used for the final rinse operation has a rinse-aid chemical added to it, this having the effect of reducing the interfacial surface tension of the final rinse liquid used with the final rinse operation, which is additionally beneficial for optimum drainage behavior and drying results.

It is also advantageous, in practical use, if additional drying fans, or similar measures for assisting the drying operation, are provided in the wash chamber (in the case of box-type dishwashers) or in the drying zone (in the case of rack-conveyor dishwashers). These measures make it possible, for example in the case of commercially used glass-washers, to reduce by up to 50% the total amount of moisture which remains, following the final rinse operation, on a drinking glass accommodated in a rack (glass-carrying rack). Tests have shown here that, with the same design of rack, depending on the shaping of the drinking glass, the total amount of moisture remaining of 0.5 g per drinking glass following a normal wash cycle without any drying assistance can be reduced for approximately 0.25 g per drinking glass in a wash cycle with drying assistance.

Arranging the set-down surfaces in an inclined manner in relation to the horizontal is advantageous not just in respect of optimizing the drip-draining properties, but also in respect of optimum utilization of the placement surfaces which can be made available by the rack, that is to say in respect of the accommodating capacity of the rack. For this purpose, the invention provides for the two set-down surfaces which are directly adjacent to one another (i.e. without any interspace therebetween) and run parallel to one another in the longitudinal direction of the rack to be inclined in relation to the horizontal such that the surface normals of the set-down surfaces diverge.

The expression "surface normal of a set-down surface of the rack" used here should be understood mathematically to mean the normal vector which is orthogonal to the set-down surface. A "set-down surface", within the context of the present disclosure, is a placement surface for washware items, i.e. a set-down row which is provided in the framework of the rack and in which washware items can be placed.

In a development of the rack according to the invention, it is provided that the set-down surfaces of the rack framework are formed, at least in certain regions, from rack struts which are inclined in relation to the horizontal. In particular, it is conceivable here for the set-down surfaces of the rack framework to be formed, at least in certain regions, from first and second rack struts which are arranged in lattice form, wherein at least the first rack struts are inclined in relation to the horizontal and are located in a plane which runs parallel to, and above, a plane in which the second rack struts are located.

In a preferred realization of the last-mentioned embodiment, it is provided, in particular, that the first rack struts of the rack framework rest on the second rack struts of the rack framework and are connected, at least at certain points or in certain regions, to at least part of the first rack struts.

Forming at least certain regions of the set-down surfaces of the rack framework from rack struts arranged in lattice form has the advantage that, following completion of the final rinse operation, the previously sprayed-on final rinse liquid can drain off as quickly as possible, and as far as possible without any resistance, from the washware accommodated in the rack and from the rack itself. Since those rack struts (first rack struts) which form the set-down surfaces of the rack framework at least in certain regions, and with which washware items accommodated in the rack are in direct contact, are inclined in relation to the horizontal plane, the drying result on the washware items accommodated in the rack can be further optimized. These rack struts serve not just as a bearing structure for the washware items accommodated in the rack, but also as drainage elements, i.e. as elements for channeling away the residual moisture remaining at the bearing locations of the washware items.

Use is made here of the finding that, in the case of racks, in particular glass-carrying racks, in which drinking glasses are positioned in appropriate set-down rows with their openings downward, relatively large accumulations of water form, following the final rinse operation, at the lowermost locations of the drinking glasses at the base of each glass and at the upper periphery of each glass. It has been established here specifically that—depending on the shape of the drinking glass—between 70% and 75% of the total amount of moisture still present on a drinking glass following the final rinse operation is present at the base of the glass and approximately 10% to 15% of the total amount of moisture is present at the upper periphery of the drinking glass. These accumulations of residual moisture cannot be prevented, in the case of standard racks, by virtue of a rinse-aid chemical being metered into the final rinse liquid. It is not possible either for these accumulations of residual moisture, in particular at the base of the glass and at the periphery of the drinking glass, to be dried off in the ambient air in the time period of two minutes which is predetermined by DIN 10511.

Since, in the case of the last-mentioned preferred realization of the rack according to the invention, the set-down surfaces of the rack framework are formed, at least in certain regions, from first and second rack struts which are arranged in lattice form, wherein at least the first rack struts are inclined in relation to the horizontal and are located in a plane which runs parallel to, and above, a plane in which the second rack struts are located, it is the case that, with the aid of the first rack struts, accumulations of residual moisture on the washware items placed on the set-down surfaces of the rack can be actively channeled away and thus removed. In the case of drinking glasses which are set down on the set-down surfaces of the rack framework with their openings downward, the first rack struts of the rack framework here are in contact with the periphery of the drinking glass, and therefore—since the first rack struts are inclined in relation to the horizontal—at least a significant amount of the water droplets remaining on the washware item following the final rinse operation can be channeled away effectively. It is therefore possible for an accumulation of water at the periphery of the drinking glass to be prevented in an effective manner.

According to preferred realizations of the rack according to the invention, the framework of the rack also has a third set-down surface, which runs parallel to the two aforementioned set-down surfaces and is directly adjacent to one of the two set-down surfaces, wherein the third set-down surface is inclined in relation to the horizontal, to be precise preferably such that the surface normal of the third set-down surface runs parallel to the surface normal of the set-down surface to which the third set-down surface is directly adjacent.

It is also conceivable here for the rack framework also to have, in addition, a fourth set-down surface, which runs parallel to the third set-down surface and is directly adjacent to the third set-down surface, wherein the fourth set-down surface is inclined in relation to the horizontal, to be precise likewise preferably in the same direction as the third set-down surface, and even more preferably such that the surface normal of the fourth set-down surface runs parallel to the surface normal of the third set-down surface.

Of course, it is also conceivable here for further set-down surfaces to be provided.

A preferred development of the rack according to the invention provides that, for the purpose of optimizing the drying result, the rack framework has a supporting-strut arrangement for supporting washware accommodated in the rack framework. The supporting-strut arrangement has at least one supporting-strut pair with a first and a second supporting strut, by means of which a washware item set down on one of the set-down surfaces of the rack framework is centered in relation to a centering axis located between the first and second supporting struts. Of course, it is also conceivable to have other embodiments for supporting and centering washware items accommodated in the framework of the rack.

In order to be able to ensure optimized drip-draining behavior, preferred embodiments of the rack according to the invention provide that the set-down surfaces are at an angle of 15° to 35°, preferably an angle of 20° to 30°, and even more preferably an angle of 24° to 26°, in relation to the horizontal.

The framework of the rack according to the invention is formed, preferably at least in certain regions, from plastics material. As an alternative, or in addition to this, it is conceivable to form the supporting struts of the rack framework, at least in part, from plastics-sheathed wire struts.

A preferred realization of the rack according to the invention provides for an additional trapezoidal space to be created by the parallel and directly adjacent set-down surfaces being arranged in an oppositely inclined manner in relation to the horizontal. This space is created in the region of the inclined set-down surfaces as a result of washware located on said set-down surfaces being tilted in opposite directions.

Provision is preferably made here for at least one goblet holder, which is designed to accommodate a glass goblet, to be provided in the region between the two directly adjacent and parallel set-down surfaces, of which the surface normals diverge. When the rack is in use, said goblet holder accommodates the body, for example, of a drinking glass, of a vase or of a glass carafe. The washware item here is fitted in an upended state onto the goblet holder. The supporting struts belonging to the goblet holder here serve for supporting and centering the drinking glass accommodated by the goblet holder.

The goblet holder is preferably of conical or frustoconical configuration, which has the advantage that drinking glasses of different diameters can always be optimally positioned and centered.

In a further preferred embodiment of the solution according to the invention, it is provided that the rack struts forming the set-down surfaces are designed, at least in part, with a degree of curvature. This degree of curvature is such that washware placed on the set-down surfaces has a reduced number of points of contact in contact with the rack struts forming the set-down surfaces.

Provision is made here for the degree of curvature of the individual rack struts to be such that the surface normal of a first region of the rack strut, in relation to the horizontal, is oriented to diverge from the surface normal of a second region of the rack strut. This means that the curved rack struts form a triangle which tapers to a point.

This shape advantageously results in washware which is placed on set-down surfaces formed in this way merely having three points in contact with the rack struts. It is thus possible for the drainage behavior to be further optimized and therefore for the drying result to be improved.

A number of embodiments of the rack according to the invention will be described in more detail, by way of example, hereinbelow with reference to the accompanying drawings, in which:

FIG. 1 shows a perspective plan view of a rack of a first exemplary embodiment of the rack according to the invention. In the case of the first exemplary embodiment, the rack is preferably designed in the form of a glass-carrying rack, in which glasses are positioned with their opening downward, i.e. in an upended state.

The framework 20 of the rack illustrated by way of example has rack struts 1,2, which are arranged in lattice form and define at least one set-down surface S1, S2, S3, S4 (for example four set-down surfaces) for the washware 10 which is to be accommodated in the rack. For easier handling, the rack also preferably has plastics-material understructures 7, which are designed to simplify the introduction of the rack into a dishwasher and to anchor the rack there in order to prevent it from changing position in an undesirable manner during the wash operation.

It is also the case that the rack is bounded by horizontal and vertical side struts 4*a*, 4*b*, 5*a*, 5*b* on its side surfaces. As can be seen from FIG. 1, the vertical side struts 4*b*, at least in certain regions, are at different heights, as a result of which the rack is designed, on a side region, to accommodate relatively large glasses. In order to create a transition between the long and short vertical side struts 4*b*, the rack framework 20 illustrated has sloping side struts 5*a*, which extend along vertical side struts 5*b*, which increase in height in a stepwise manner.

The rack according to the invention is preferably an injection-molded plastics-material rack or a plastics-coated wire rack. On the other hand, however, it would also be conceivable for the rack framework 20 to be formed from stainless steel without any coating. A plastics-coated wire rack has a higher level of water permeability, this giving rise to a better cleaning and drying result, in which case such plastics-coated wire racks are the preferred option for use in under-counter dishwashers. Plastics-material racks, in contrast, can be stacked and stored to better effect and are used predominantly in relatively large kitchens, rack-conveyor or flight-type dishwashers ensuring the required wash result here by way of relatively high performance data.

Figure 1:
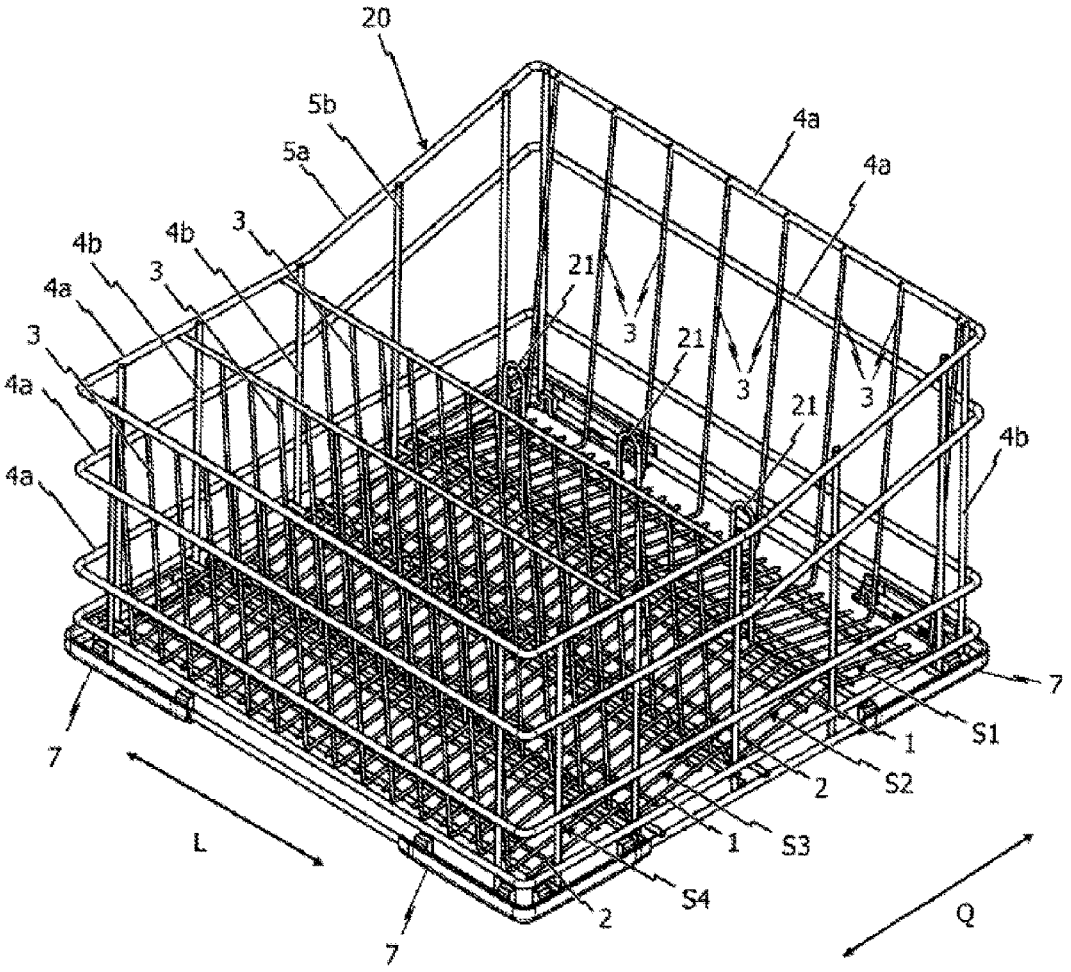
FIG. 1 shows a perspective plan view of a rack according to the first exemplary embodiment of the present invention.
Figure 2:
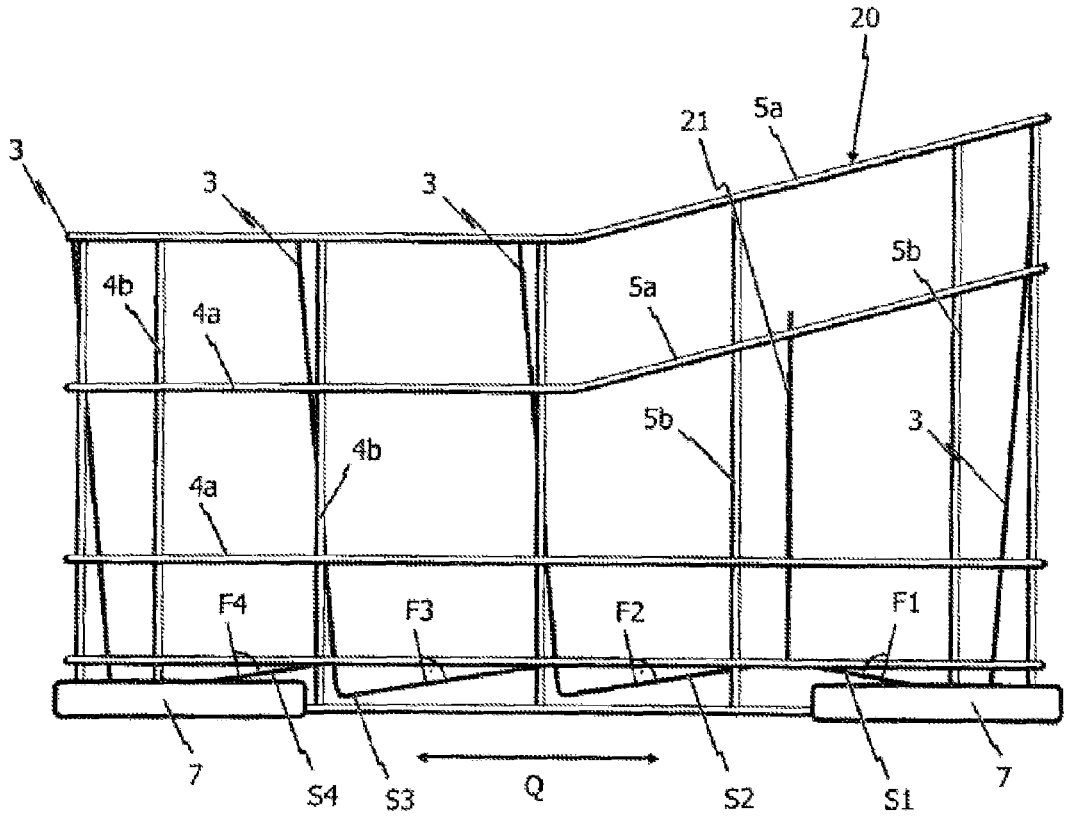
FIG. 2 shows a side view of a rack according to a first exemplary embodiment of the present invention.

FIGS. 1 and 2 show a rack for dishwashers, in particular commercial dishwashers, wherein the rack has a rack framework 20 with at least two directly adjacent set-down surfaces S1 and S2 which are intended for washware 10 and run parallel to one another in the longitudinal direction L of the rack. The set-down surfaces S1, S2 are inclined in relation to the horizontal such that the surface normals F1, F2 (FIG. 2) of the set-down surfaces S1, S2 diverge. As a result of the set-down surfaces S1, S2 being formed in this specific way, said set-down surfaces S1, S2 are embodied in a state in which they are tilted in relation to one another.

The expression "surface normal" in relation to the various set-down surfaces S1, S2, S3, S4 can be understood mathematically to mean a vector which is orthogonal to the plane formed by the set-down surface S1, S2, S3, S4. This describes the spatial position of the set-down surfaces S in particular in relation to the horizontal H. The "set-down surface", which is referred to a number of times throughout this disclosure, refers to a placement surface for washware items, i.e. a set-down row which is provided in the framework 20 of the rack and in which the washware items can be placed.

In specific terms, and as can be gathered, in particular, from the illustration in FIG. 2, which shows the rack-framework region in a side view, the set-down surfaces S1, S2, S3, S4 are inclined in relation to the horizontal. The set-down surfaces S1, S2, S3, S4 are at an angle of 15° to 35°, preferably an angle of 20° to 30°, and even more preferably an angle of 24° to 26°, in relation to the horizontal. In an alternative embodiment, it is also possible for the set-down surfaces S1, S2, S3, S4 to be at a smaller angle of approximately 10° in relation to the horizontal.

The inclination of the set-down surfaces S1, S2, S3, S4 in relation to the horizontal, and the fact that the inclined set-down surfaces S1, S2, S3, S4 are located directly parallel to one another, means that the washware 10 can be accommodated in an optimized manner in the rack. In particular, the tilted arrangement of the washware items in relation to one another and in relation to the horizontal H avoids the situation where any space present between the washware items remains unused. This means that any possible "dead space" can be minimized in an effective manner. Overall, the orientation of the set-down surfaces S1, S2, S3, S4 according to the invention allows the highest possible number of washware items to be accommodated in the rack.

According to those two embodiments of the rack according to the invention which are illustrated in the figures, the framework 20, which forms the rack, also has a third set-down surface S3. This third set-down surface S3 runs parallel to the aforementioned set-down surfaces S1 and S2 and is connected thereto preferably directly, i.e. without any interspace being located between the set-down surfaces. The third set-down surface S3 here is inclined in relation to the horizontal, to be precise preferably such that the surface normal F3, which describes the third set-down surface S3, has the same inclination as the surface normal F2 of the aforementioned second set-down surface S2. This makes it possible, in turn, to avoid any possible "dead space" between the various set-down surfaces and to optimize the accommodating capacity of the rack in respect of different kinds of washware 10.

Provision is also made, as illustrated in the figures, for the rack according to the invention to have a fourth set-down surface S4. This fourth set-down surface S4 is designed here such that it is inclined in relation to the horizontal, to be precise likewise in the same direction as the third set-down surface S3, and even more preferably such that the surface normal F4 of the fourth set-down surface S4 runs parallel to the surface normal F3 of the third set-down surface S3. The fourth set-down surface S4 is preferably adjacent to the third set-down surface S3. Once again, the intension is for the angle of inclination of the fourth set-down surface to optimise the useful space of the rack to the extent where the latter makes best possible use of the space available for accommodating different kinds of washware 10.

Of course, it is also conceivable here for further set-down surfaces (not illustrated) to be provided in the rack, wherein these are preferably arranged parallel to the set-down surfaces S1, S2, S3, S4 which are already present and, even more preferably, should have a similar angle of inclination in relation to the horizontal.

The framework 20 of the rack according to the invention is preferably formed, at least in certain regions, from plastics material. As an alternative, or in addition to this, it is conceivable for the supporting struts 1, 2 of the rack framework 20 to be formed, at least in part, from plastics-sheathed wire struts.

Figure 3:
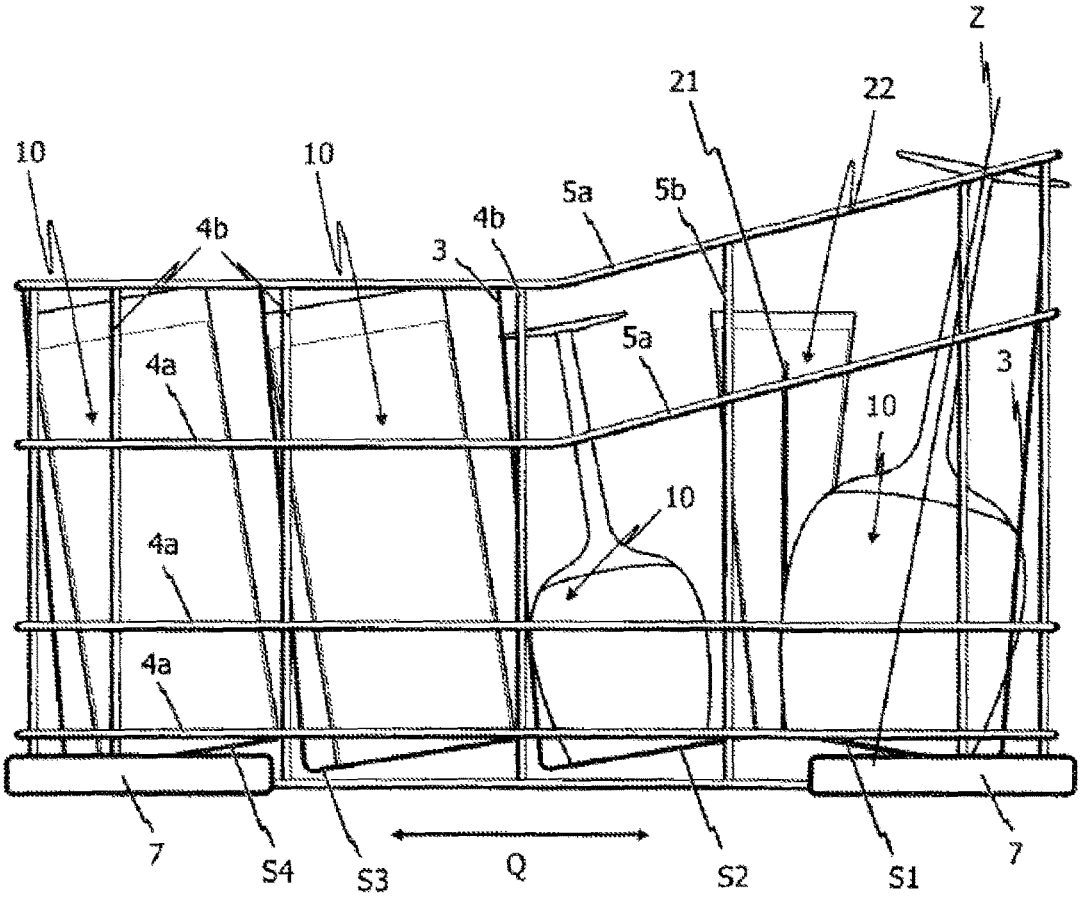
FIG. 3 shows a side view of a completely filled rack according to the exemplary embodiment of the present invention.

In the first embodiment of the solution according to the invention, which can be seen in FIGS. 1 and 2, and in particular, FIG. 3, it is provided that use is made of at least one conical or frustoconical goblet holder 21 in order to position different kinds of elongate washware 22, in particular vases and goblets, in optimized fashion in the rack framework 20.

It can also be gathered from FIG. 3 that arranging the set-down surfaces S1, S2 in an inclined manner in relation to the horizontal gives rise to an essentially trapezoidal interspace between the washware 10 arranged on the set-down surfaces S1 and S2, it being possible for said interspace to be utilized to accommodate elongate washware 22, such as vases or goblets. In other words, provision is made for said trapezoidal interspace to be utilized for fitting the goblet holder 21. The goblet holder 21 extends in particular vertically upward, starting from a connecting region between the two set-down surfaces S1 and S2, which are inclined in relation to one another.

In other words, this embodiment provides for at least one goblet holder 21, which is preferably designed to accommodate elongate washware items 22 (e.g. glass goblets), to be located in the connecting region between the two directly adjacent and parallel set-down surfaces S1 and S2, of which the surface normals F1, F2 diverge. The goblet holder 21 comprises, for example, two supporting struts which are oriented vertically and are designed to accommodate the above described, elongate, washware items 22, wherein the supporting struts also serve to center, and orient, the washware items when the latter are fitted in an upended state onto the goblet holder 21.

The goblet holders 21 are preferably introduced in the region between the two directly adjacent and parallel set-down surfaces S such that they are arranged in a slightly offset state in relation to the washware 10 located on the set-down surfaces S1 and S2. It is thus possible, in the case where the washware 10 is round, for the washware 10 located on the goblet holders 21 not to have any contact with the washware 10 accommodated on the set-down surfaces S. This makes ideal use of the trapezoidal interspace which arises as a result of the tilted set-down surfaces S1, S2.

It is also the case that optimized drainage behavior of the wash water is realized for the embodiment of the rack according to the invention. In detail, following the final rinse operation, a relatively large amount of water accumulates at the lower region 11*a* of a washware item 10*a* (FIG. 4), and this water has to be channeled away as efficiently as possible so that an optimum drying effect can be achieved. The rack according to the invention therefore has drainage elements in the form of optimized-arrangement rack struts 2. These rack struts 2 designed in the form of drainage elements serve for channeling away or draining the water collected at the lower region 11*a* of the washware items 10*a*.

Figure 4A:
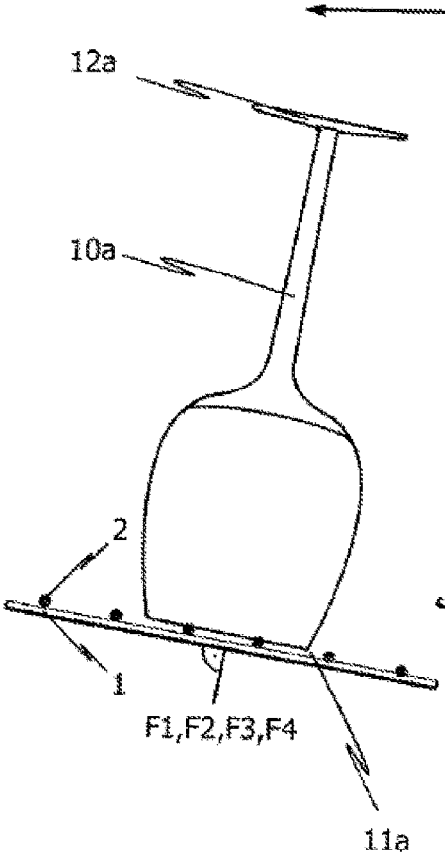
Fig. 4a (Prior art)
FIG. 4 shows a side view, in section, of washware items standing on rack struts.
Figure 4B:
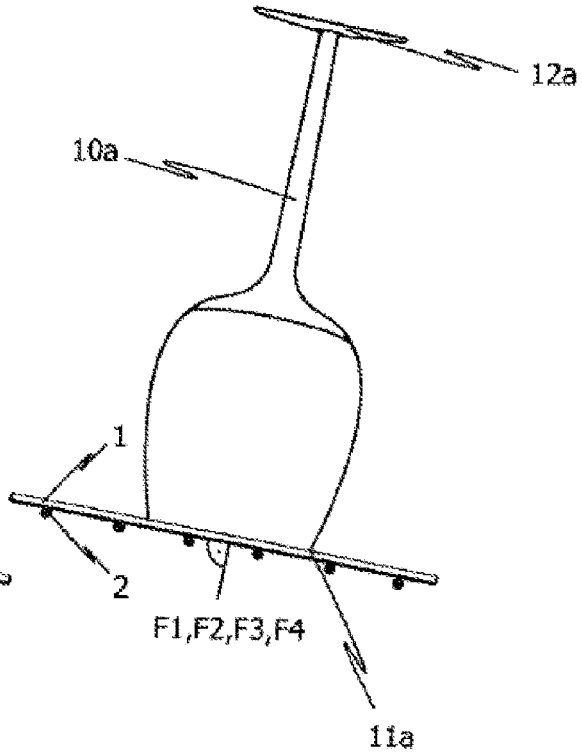

As can be seen in FIG. 4*b*, in the case of an exemplary embodiment of the solution according to the invention, the first, transversely running rack struts 1 of the rack framework 20 rest on the second, longitudinally running rack struts 2 of the rack framework 20 and are connected, at least at certain points or in certain regions, to at least part of the longitudinal struts. Accordingly, first, transversely running rack struts 1 are always located in a plane which is located above the plane of the corresponding second rack struts 2. This ensures that the lower region 11*a* of the washware item 10*a* is always in contact with the first struts 1. Since these first struts 1 are arranged parallel to the preferred drainage direction of residual water remaining on the washware item 10*a*, this arrangement allows residual water to be channeled away efficiently from the lower region 11*a* of the washware item 10*a*.

In the case of conventional racks, as shown in FIG. 4*a*, usually relatively large regions of the washware 10 are surrounded by air, such that relatively large quantities of water can collect at these points. In contrast to this, the corresponding regions, which can be seen in FIG. 4*b*, of the rack according to the invention are in direct contact with the first rack struts 1 and thus in direct contact with possible accumulations of water at the respectively lowermost point of the respective washware item. If materials are selected in a suitable manner, the interfacial surface tension between the rack strut 1 and water droplets can then be selected such that most of the water located at the lower end of the washware item can be channeled away.

In particular, it is conceivable here for the set-down surfaces S1, S2, S3 and S4 of the rack framework 20 to be formed, at least in certain regions, from first and second rack struts 1 and 2 which are arranged in lattice form, wherein the rack struts each form a plane together with their parallel neighbor. As a result, the first rack struts 1 form a first plane and the second rack struts 2 form a second plane, wherein the two planes run parallel in relation to one another. Moreover, the planes formed from the rack struts are preferably arranged such that the plane formed from the first rack struts 1 is located above the plane formed from the second rack struts 2. This means that the washware 10 placed on the set-down surfaces S1, S2, S3, S4 comes into contact exclusively with the first rack struts 1 and, as described above, the residual water located on the washware 10 can drain off along said rack struts 1.

In this preferred embodiment, the drainage elements are therefore in direct contact with the respective peripheries of the washware 10. Tipping these drainage elements horizontally makes it possible to optimize further the drying result on the washware items accommodated in the rack, since said rack struts 1 do not just serve as a bearing structure for the washware items accommodated in the rack; rather, they are optimized, in particular, such that they allow for the residual moisture remaining at the bearing locations of the washware items to be channeled away in an improved manner.

This design is based on the finding that an increased amount of water accumulates at the base of the glass and at the upper periphery of the glass, at the end of the wash phase, in comparison with the other regions of the washware. It is actually the case that between 70% and 75% of the total amount of moisture still present on a drinking glass following the final rinse operation is present at the base of the glass and approximately 10% to 15% of the total amount of moisture is present at the upper periphery of the drinking glass. To this extent, it is of critical importance for the subsequent drying result of the washware that the amounts of water located in this region are channeled away in optimized fashion from the washware 10 and are therefore no longer in direct contact with the washware 10. It should be noted here that it is precisely in areas where the locally used water supplied to the dishwasher has a relatively high proportion of dissolved substances, in particular lime, that the desired result in terms of washing and drying depends significantly on the amount of water remaining in the washware 10. Reducing this amount of water therefore ensures a significantly improved wash result.

In particular for the case where the washware 10 is in the form of drinking glasses which are set down in the downward direction on the set-down surfaces S of the rack framework 20, the first rack struts 1 of the rack framework 20 are in direct contact with the drinking periphery of the drinking glass, and therefore the remaining water droplets can be channeled away effectively and, in particular, residues, such as limescale stains, which detract from the appearance of the glasses can be reduced.

Figure 5:
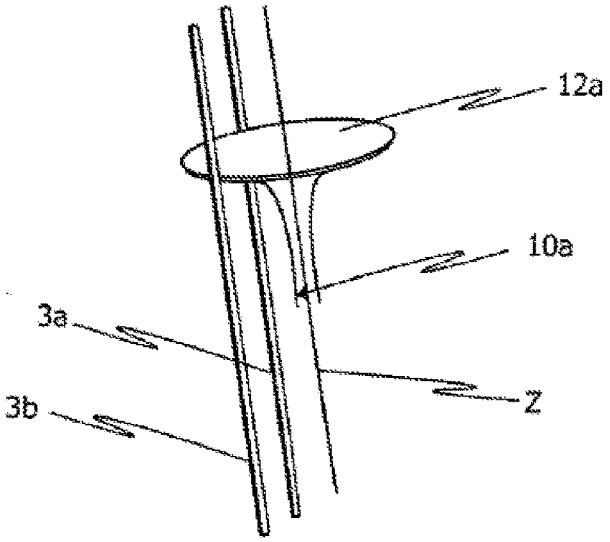
FIG. 5 shows a perspective plan view of a washware item in contact with a supporting-strut arrangement.
Figure 6:
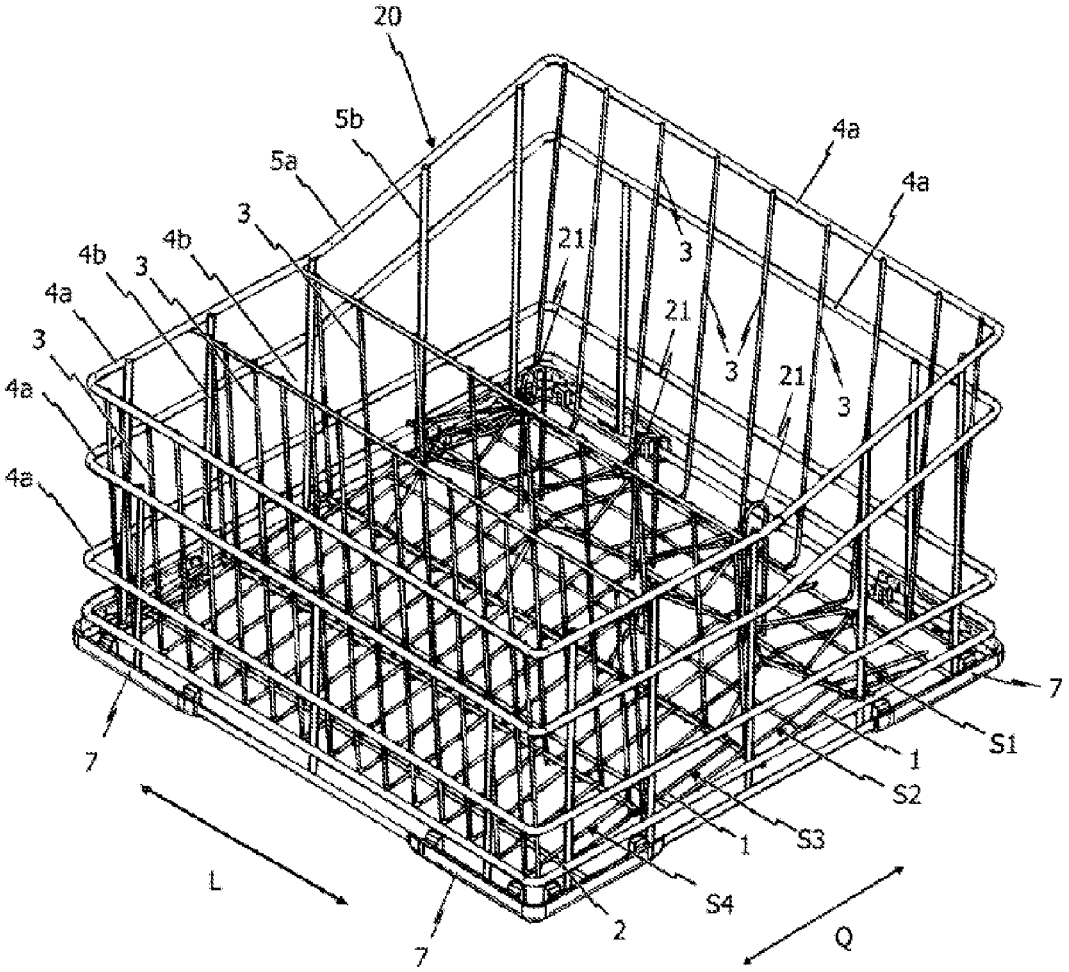
FIG. 6 shows a perspective plan view of a rack according to a further exemplary embodiment of the present invention.

In a further preferred embodiment, and as can be seen in FIG. 5, provision is made for the rack also to have a supporting-strut arrangement 3 for supporting the washware set down on the inclined set-down surfaces S1, S2, S3, S4. In specific terms, the supporting-strut arrangement 3 according to the exemplary embodiment illustrated has at least one supporting-strut pair 3*a*, 3*b*, comprising first supporting struts 3*a* and second supporting struts 3*b*. A washware item 10*a* set down on the set-down surface S1, S2, S3, S4 is centered, by the supporting struts 3*a*, 3*b*, in relation to a centering axis Z, between the first and the second supporting struts 3*a*, 3*b*. The centering axis Z is depicted in FIG. 5 and corresponds, in the case of the embodiment illustrated, to the axis of rotation of the washware item 10*a*, which in this exemplary embodiment is of rotationally symmetrical configuration.

As can be gathered from the illustration in FIG. 5, the supporting-strut arrangement 3 is configured such that washware items of different geometries and different sizes can be centered, with the aid of the first and second supporting struts 3*a*, 3*b*, in relation to the centering axis Z, which runs between the two supporting struts 3*a*, 3*b*. In the case of the exemplary embodiment illustrated, a washware item 10*a* which is arranged, and centered, between the supporting struts 3*a*, 3*b* is supported, on the one hand, on the two supporting struts 3*a*, 3*b* via its base region 12*a* and, on the other hand, on the set-down surface S via its drinking-periphery region 11*a* at the upper end region.

Figure 7:
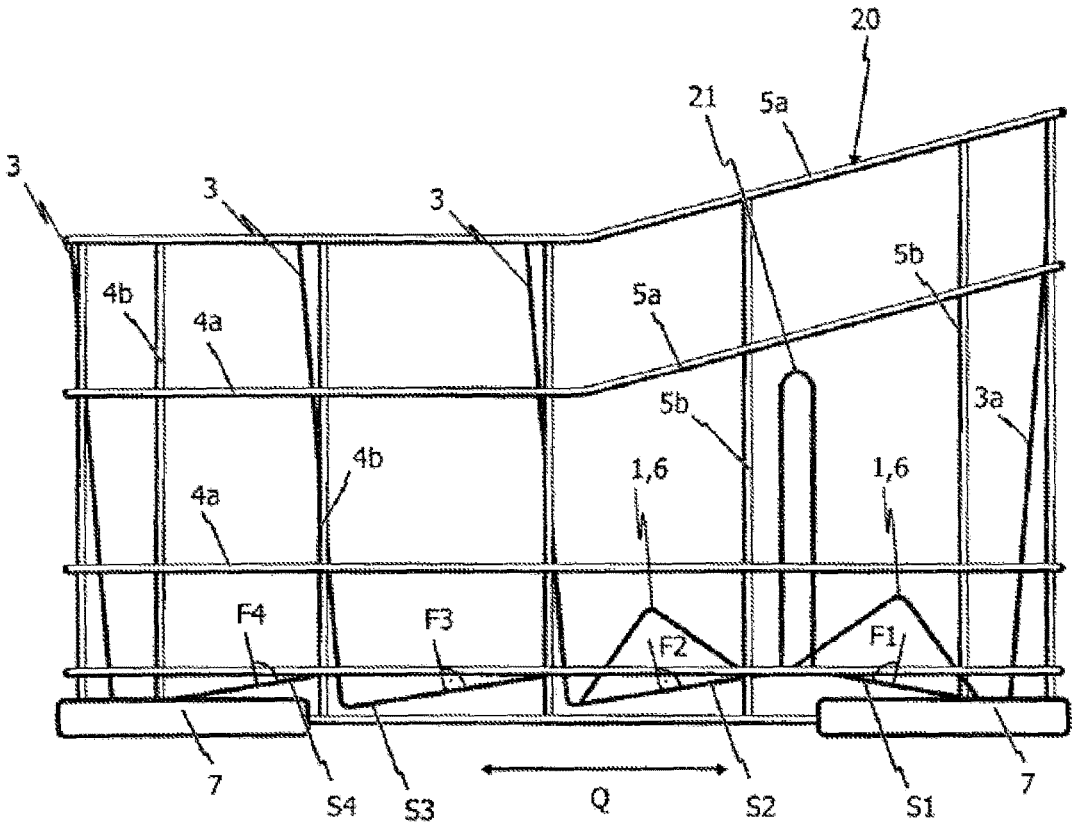
FIG. 7 shows a side view of a rack according to a further exemplary embodiment of the present invention.
Figure 8:
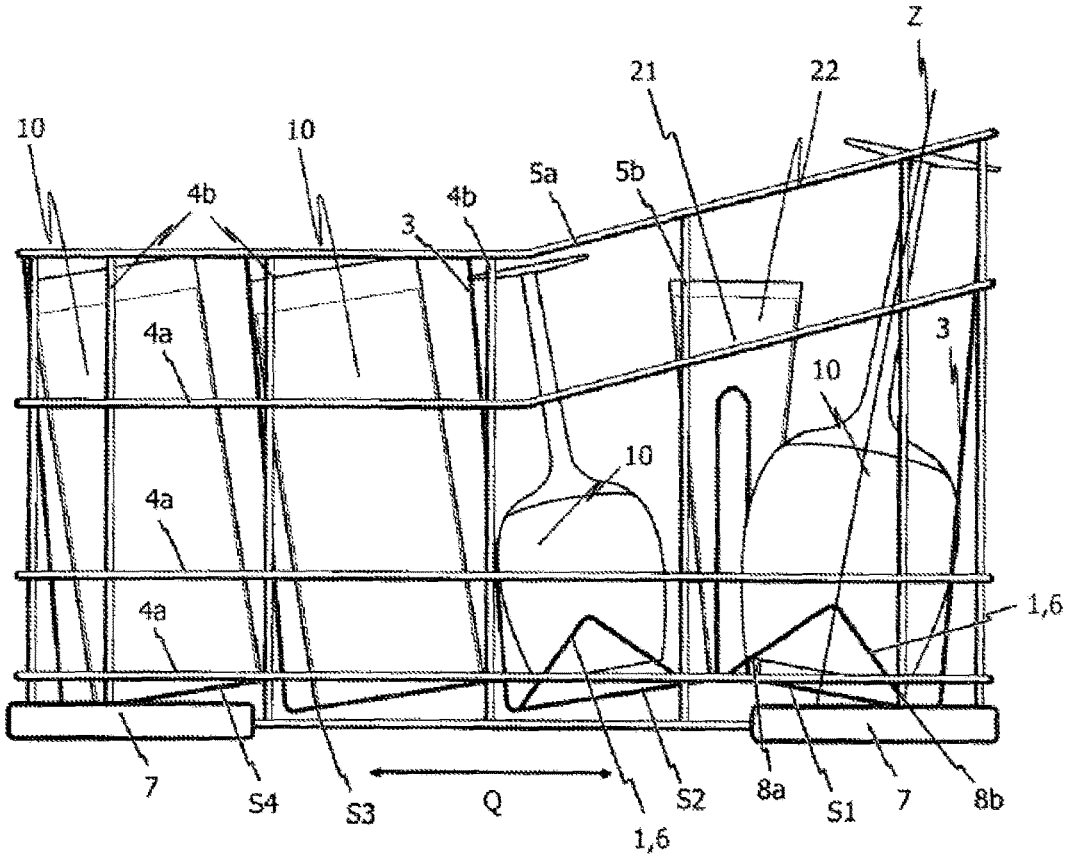
FIG. 8 shows a side view of a completely filled rack according to a further exemplary embodiment of the present invention.

In a second embodiment of the solution according to the invention, the set-down surfaces S1, S2 of the directly adjacent set-down surfaces designed with diverging surface normals are provided with at least partially optimized rack struts 1, which can be seen in FIGS. 7, 8 and 9. These rack struts 1 are formed such that they have a degree of curvature 6, wherein a first and a second region of the rack strut 1 have surface normal which are tilted in a state in which they diverge from one another in relation to the horizontal.

Forming at least some rack struts 1 as curved rack struts makes it possible for washware items 10*a* which are placed on the directly adjacent set-down surfaces S1, S2, which differ from one another by way of diverging surface normals F1, F2, to have a reduced number of points of contact 8*a*, 8*b* (FIG. 7) come into contact with the rack struts 1 which form the set-down surfaces. In particular, the degree of curvature 6 of the rack struts 1 is selected such that the washware items 10*a* have at most three points of contact in contact with the rack struts 1.

Such a formation of the rack struts 1, which form the set-down surfaces S1, S2, S3, S4, makes it possible for the drainage of water at the end of the wash and drying process to be improved further, to be precise to the extent where a reduced number of points of contact 8*a*, 8*b* means, on the one hand, that the probability of droplets forming at these points of contact 8*a*, 8*b* is reduced and, on the other hand, that an increased amount of water flows off at the points of contact 8*a*, 8*b*. This is the case since it is approximately always the same amount of water which runs down off a predetermined article of washware 10 at the end of the wash operation. If this amount of water, then, is distributed over a number of points of contact, the surface tension of the water droplets means that, in total, a relatively large amount of water remains adhering to the points of contact. If the number of points of contact, in contrast, is reduced, this same amount of water has to drain off at fewer points of contact, as a result of which the total amount of water draining off is increased, since an approximately constant amount of water remains behind at each point of contact.

The solution according to the invention is not restricted to the embodiments presented above with reference to the drawings; rather, it can be gathered from a combination of all the features disclosed herein.

The invention is suitable, in particular, as a glass-carrying rack for accommodating drinking and/or eating vessels made of glass or a glass-like material.

LIST OF DESIGNATIONS

1 First rack strut
2 Second rack strut
3 Supporting struts
3*a* First supporting strut
3*b* Second supporting strut
4*a*, 4*b*, Side struts
5, 5*b*
6 Degree of curvature
7 Plastics-material understructure
8*a*, 8*b* Point of contact
10 Washware
10*a* Washware item
20 Rack framework
21 Goblet holder
22 Glass goblet
L Longitudinal direction
S1, S2, Set-down surface
S3, S4
Q Transverse direction
F Surface normal
H Horizontal

The invention claimed is:

1. A rack for dishwashers, wherein the rack has a rack framework with two directly adjacent set-down surfaces which are intended for washware and run parallel to one another in a longitudinal direction of the rack, wherein the set-down surfaces are inclined in relation to horizontal such that respective surface normals of the set-down surfaces diverge;

wherein the set-down surfaces of the rack framework are formed, at least in certain regions, from a plurality of rack struts which are inclined in relation to horizontal;

wherein at least some of the plurality of racks struts forming the two directly adjacent set-down surfaces, which run parallel to one another in the longitudinal direction of the rack, have, at least in part, a degree of curvature in relation to a transverse direction of the rack, this degree of curvature in each case being along a transverse mid-portion of the set-down surface and formed such that washware located on the plurality of rack struts is in contact with the plurality of rack struts at, at most, three points of contact.

2. The rack as claimed in claim 1, wherein the plurality of rack struts forming the set-down surfaces of the rack framework include, at least in certain regions, a first plurality of rack struts and second plurality of rack struts which are arranged in lattice form, wherein at least the first plurality of rack struts are inclined in relation to horizontal and are located in a plane which runs parallel to, and above, a plane in which the second plurality of rack struts are located.

3. The rack as claimed in claim 2, wherein the first rack plurality of rack struts of the rack framework rest on the second plurality of rack struts of the rack framework and are connected, at least at certain points or in certain regions, to at least part of the first plurality of rack struts.

4. The rack as claimed in claim 3, wherein the first plurality of rack struts, which are inclined in relation to horizontal, run in a transverse direction of the rack.

5. The rack as claimed in claim 4, wherein the plurality of rack struts of the rack framework are, at least in part, plastics-sheathed wire struts.

6. The rack as claimed in claim 1, wherein the rack framework is provided with a third set-down surface, which runs parallel to the two set-down surfaces and is directly adjacent to one of the two set-down surfaces, wherein the third set-down surface is inclined in relation to horizontal, such that a surface normal of the third set-down surface runs parallel to the surface normal of the set-down surface to which the third set-down surface is directly adjacent.

7. The rack as claimed in claim 6, wherein the rack framework is provided with a fourth set-down surface, which runs parallel to the third set-down surface and is directly adjacent to the third set-down surface, wherein the fourth set-down surface is inclined in relation to horizontal in the same direction as the third set-down surface, such that a surface normal of the fourth set-down surface runs parallel to the surface normal of the third set-down surface.

8. The rack as claimed in claim 1, wherein the rack framework also has at least one supporting-strut arrangement for supporting washware accommodated in the rack framework, wherein the supporting-strut arrangement has at least one supporting-strut pair which is formed from a first and a second supporting strut and is arranged for centering a washware item set down on one of the set-down surfaces of the rack framework.

9. The rack as claimed in claim 1, wherein the set-down surfaces of the rack framework are inclined in relation to horizontal by 20 degrees to 30 degrees.

10. The rack as claimed in claim 1, wherein the set-down surfaces of the rack framework are inclined in relation to horizontal by 24 degrees to 26 degrees.

11. The rack as claimed in claim 1, wherein at least one goblet holder is provided, this being arranged in a connecting region between the two set-down surfaces and being designed to accommodate a glass goblet.

12. The rack as claimed in claim 11, wherein the goblet holder is of conical or frustoconical design.

13. The rack as claimed in claim 12, wherein the goblet holder runs perpendicularly in relation to horizontal.

14. The rack as claimed in claim 1, wherein the rack framework is formed, at least in certain regions, from plastics material.

* * * * *